United States Patent [19]

Vanderburg

[11] Patent Number: 4,686,505

[45] Date of Patent: Aug. 11, 1987

[54] EMERGENCY LIGHTING SYSTEM

[76] Inventor: Curtis E. Vanderburg, 1132 Mermaid Dr., Annapolis, Md. 21401

[21] Appl. No.: 649,926

[22] Filed: Sep. 13, 1984

[51] Int. Cl.[4] ..... G08B 5/38

[52] U.S. Cl. ..... 340/331; 40/564

[58] Field of Search ..... 40/564, 568, 573; 340/330, 331, 332; 116/4, 5, 22 R, 122; 362/351, 812

[56] References Cited

U.S. PATENT DOCUMENTS

| | | | |
|---|---|---|---|
| 3,015,900 | 1/1962 | Frink | 40/564 |
| 3,092,826 | 6/1963 | Klingner | 362/812 |
| 3,360,791 | 12/1967 | Lazar | 340/330 |
| 3,968,584 | 7/1976 | Kingston | 362/812 |
| 4,042,919 | 8/1977 | Patty | 340/331 |
| 4,129,857 | 12/1978 | Espinosa | 340/330 |
| 4,157,531 | 6/1979 | Mont | 40/573 |
| 4,254,457 | 3/1981 | Lordier | 362/812 |
| 4,328,481 | 5/1982 | Sexton | 340/331 |
| 4,518,946 | 5/1985 | Solomon | 340/331 |

FOREIGN PATENT DOCUMENTS

| | | | |
|---|---|---|---|
| 1455173 | 11/1976 | United Kingdom | 40/564 |

*Primary Examiner*—John W. Caldwell, Sr.
*Assistant Examiner*—Alvin Oberley
*Attorney, Agent, or Firm*—Walter G. Finch

[57] ABSTRACT

The invention concerns an emergency lighting apparatus which is activated by a homeowner in the event of an emergency. Transparent house numbers are illuminated from behind, while a strobe light is flashed. The illuminated numbers are mounted on the face of a first compartment and the strobe light is mounted within a second compartment. The two compartments are surrounded by a water-tight housing which might be readily attached to a building.

4 Claims, 3 Drawing Figures

EMERGENCY LIGHTING SYSTEM

BACKGROUND OF THE INVENTION

During an emergency in the home individuals summon the police department, fire department or paramedics for help. Typically, a response is made within a matter of minutes. However, valuable time may be consumed if the responding law officers or paramedics, for instance, are unfamiliar with the location in which the home is situated. Too often, house numbers are not visible from the street and the responding vehicle must cruise up and down a street in search of a particular home. It is apparent that these precious moments could be preserved, if the responding vehicle could readily determine in which home the emergency situation existed.

OBJECTS AND SUMMARY OF THE INVENTION

The invention concerns an apparatus for illuminating house street numbers and for flashing a strobe when activated.

It is an object of this invention to provide a device which is easily activated and which conspicuously indicates an emergency situation exists.

It is another object of the present invention to provide an emergency indicator which is readily visible at a great distance.

The emergency illuminating apparatus comprising the present invention includes a housing having two compartments. On the face of a first compartment are mounted the appropriate house numbers representing the street address. Behind this face and within the first compartment are a plurality of light fixtures. When activated, the light fixtures illuminate the house numbers which are transparent, as opposed to the face which is opaque. A second compartment houses a strobe light which is activated separately only when an emergency situation exists. The flashing strobe is highly visible through a transparent face plate in the direction of the street. Mounted upon the housing is a switch for activating the emergency lighting apparatus. On the back of the housing, opposite the base end face plate, are two slotted holes for easy mounting of the housing to an individual's home. Power is supplied to the emergency lighting apparatus via a standard electrical wire or cable which may be connected to an ordinary household outlet.

BRIEF DESCRIPTION OF THE INVENTION

DETAILED DESCRIPTION OF THE INVENTION

Figure 1:
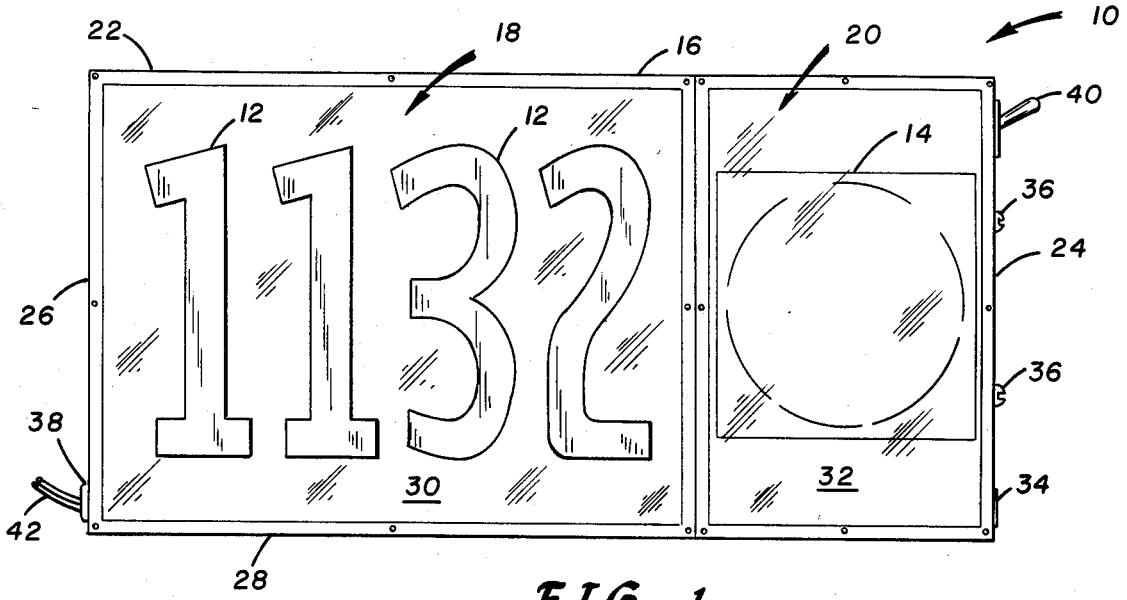
FIG. 1 shows a front view of the emergency lighting apparatus.

The emergency lighting apparatus according to the present invention is shown in a preferred embodiment at 10, generally. Numbers, representing the street address of a house, (chosen arbitrarily) are shown at 12 which are made of a transparent material. A strobe 14 is shown on the right side of FIG. 1, the strobe 14 and transparent house numbers 12 comprising the major features of the emergency lighting apparatus 10, as discussed below.

The transparent house numbers 12 and strobe 14 are mounted in a housing 16 which is divided into a first compartment 18 and second compartment 20. The housing 16 includes a top 22, right side 24, left side 26, and bottom 28 which are sealed relative to one another to protect the components (discussed below) of the emergency lighting apparatus 10 from rain, snow, sleet and the like. The transparent house numbers 12 are, in the preferred embodiment, integral with an opaque face plate 30 which covers the front of the first compartment 18. Thus, when the interior of the first compartment is illuminated, the transparent house numbers 12 appear to be lighted. In another embodiment, the house numbers 12 may be opaque and mounted or painted on a transparent face plate 30, such that illumination from within the first compartment 18 causes the house numbers to appear as silhouettes. The strobe 14 is mounted in the second compartment 20 behind a transparent plate 32 which allows the full intensity of the strobe light 14 to be transmitted. In this embodiment, the strobe light 14 is secured to the housing right side 24 by a pair of screws 36. A switch 40 is mounted to the housing right side 24, which controls the operation of the emergency lighting apparatus. When switch 40 is placed in the on position the strobe light 14 within the second compartment begins flashing. When switch 40 is placed in the off position, the switch 40 causes the strobe to darken. Power is provided to the emergency lighting apparatus 10 via wire 42 which may be a 110 volt supply line, plugged into a typical household outlet. A grommet 38 surrounds the wire 42 to prevent moisture from entering the housing left side 26. The wire 42 enters the housing 16 via a knockout hole which, in this instance, is filled by the grommet 38. An auxiliary knockout 34 is shown in the housing 16 and may be used if it is desired that wire 42 enter the opposite side of housing 16.

Figure 2:
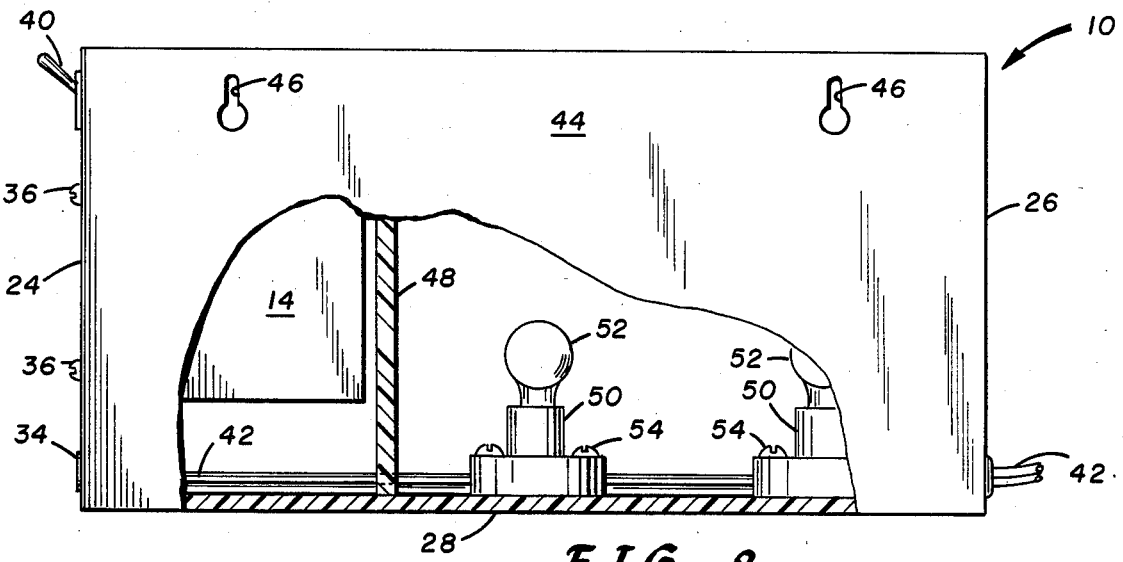
FIG. 2 is a cutaway view of the rear side of the emergency lighting apparatus.

FIG. 2 is a rear view of the emergency lighting apparatus 10, wherein a backplate 44 of the housing 16 is visible. Two slotted holes 46 are provided in the rear plate 44 to facilitate mounting of the emergency lighting apparatus. The round portions of the slotted holes 46 may be slipped over nail heads, for instance, (hammered into a building structure, e.g.) until the slotted portion engages the nail shank. An interior wall 48 divides the housing 16 into the two compartments 18 and 20. As is evident from this cutaway view, two socket fixtures 50 holding light bulbs 52 are mounted to the housing bottom 28. Screws 54 secure the socket fixtures 50 in place. Each socket fixture 50 is electrically connected to the supply wire 42, such that current passing through the supply wire 42 will illuminate the bulbs 52. The supply wire 42 passes through the interior wall 48 and is electrically connected to the switch 40 and strobe light 14 in a known manner and is, therefore, not discussed further.

Figure 3:
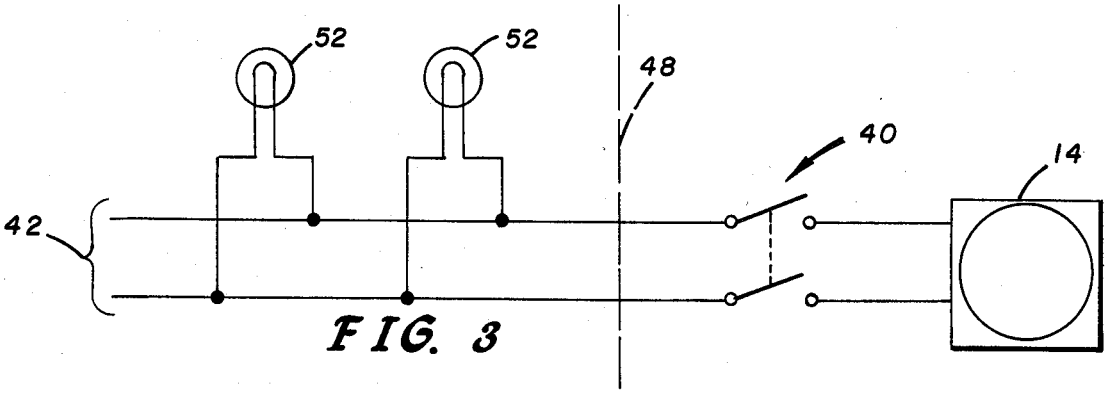
FIG. 3 is a schematic of the circuit enclosed within the emergency lighting apparatus.

A schematic diagram in FIG. 3 which represents the electrical connections of the component housed within the housing 16. The two bulbs 52 are connected in parallel to one another across the 110 volt supply provided by wire 42. As connected, in the event one bulb's filament burns out, the second bulb will continue to function. Connected next in line is a single-throw, double-pole switch 40 which opens or closes both lines of the supply wire 42. The strobe light 14 is in parallel with the single-throw double-pole switch 40 and the two bulbs 52. Accordingly, when the switch 40 is closed the 110 volt supply causes the strobe light 14 to flash.

Other modifications are apparent to one skilled in the art which do not depart from the spirit of the invention. For instance, the strobe light 14 may be mounted in any manner to the interior of the second compartment 20. Brackets may be provided on the backplate 44, rather than slotted holes 46. The switch 40 may be replaced with an electrical push-button and a battery may be substituted for the supply wire 42. Accordingly, the described embodiments, are therefore considered to be only illustrative and not restrictive: the scope of the invention being defined by the appended claims.

What is claimed is:

1. An emergency lighting apparatus, comprising, a rigid housing; an interior wall within said housing dividing said housing into first and second rigid compartments; a first face plate having numbers thereon mounted to said housing in front of said first compartment, said first plate being opaque and integral with the numbers thereof, with said numbers being transparent; a second face plate mounted to said housing in front of said second compartment, said second face plate being transparent; an illuminating means mounted within said first compartment, said illuminating means including a plurality of socket fixtures with light bulbs mounted therein, said plurality of socket fixtures being secured within said first compartment, said plurality of socket fixtures being secured in place by screws and electrically connected in parallel; a strobe means mounted within said second compartment, said strobe light being electrically connected in parallel with said plurality of socket fixture; an electrical connecting means connected to carry power to said flashing means and illuminating means, said housing having an aperture through which said electrical connecting means passes; and a switch means also connected to said electrical connecting means for actuating said flashing means and said illuminating means.

2. An emergency lighting apparatus as in claim 1, said switch means comprising a single-throw, double sole switch also electrically connected in parallel with said plurality of socket fixtures, and which is mounted to said exterior of said housing.

3. An emergency lighting apparatus as in claim 2, said electrical connecting means comprising an electrical wire, a grommet mounted in said aperture, to sealingly surround said electrical wire.

4. An emergency lighting apparatus as in claim 3, said housing having a rear plate, a mounting means thereon for mounting said housing to a structure, said mounting means comprising slotted holes in said rear plate.

* * * * *